US010093508B1

(12) United States Patent
Mizutani

(10) Patent No.: US 10,093,508 B1
(45) Date of Patent: Oct. 9, 2018

(54) CARD SEPARATION APPARATUS AND CARD SEPARATION METHOD

(71) Applicants: KABUSHIKI KAISHA TOSHIBA, Tokyo (JP); TOSHIBA TEC KABUSHIKI KAISHA, Tokyo (JP)

(72) Inventor: Kikuo Mizutani, Izu Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/671,569

(22) Filed: Aug. 8, 2017

(51) Int. Cl.
*B65H 29/54* (2006.01)
*B65H 43/00* (2006.01)
*B65H 31/24* (2006.01)

(52) U.S. Cl.
CPC ..... *B65H 29/54* (2013.01); *B65H 31/24* (2013.01); *B65H 43/00* (2013.01); *B65H 2701/1131* (2013.01); *B65H 2701/1914* (2013.01); *B65H 2801/24* (2013.01)

(58) Field of Classification Search
CPC ..... B65H 29/54; B65H 29/64; B65H 31/04; B65H 31/08; B65H 31/24; B65H 43/00; B65H 43/08; B65H 2701/1914
See application file for complete search history.

(56) References Cited

U.S. PATENT DOCUMENTS 5,139,386 A * 8/1992 Honegger ..... B65H 29/001 271/283
7,137,554 B2 * 11/2006 Bretl ..... B65H 45/18 235/445
2004/0089706 A1 * 5/2004 Hill ..... B42D 5/027 235/375
2017/0068202 A1 * 3/2017 Nakano ..... B65H 29/242

FOREIGN PATENT DOCUMENTS

JP H08189830 A 7/1996

* cited by examiner

*Primary Examiner* — Ernesto A Suarez
(74) *Attorney, Agent, or Firm* — Patterson & Sheridan, LLP

(57) ABSTRACT

A card separation apparatus includes a movable tray having a surface onto which a sheet is conveyed after a card has been separated from the sheet, and a card separation unit mounted on the surface for movement with the movable tray, the card separation unit having an opening through which the sheet is conveyed, and a controller configured to send an instruction to the movable tray to be moved at a predetermined timing after a leading edge of the sheet to which the card is attached enters the opening, so as to cause the sheet to be initially separated from the card.

20 Claims, 10 Drawing Sheets

CARD SEPARATION APPARATUS AND CARD SEPARATION METHOD

FIELD

Embodiments described herein relate generally to a card separation apparatus and a card separation method.

BACKGROUND

A sheet which is subjected to being conveyed in an image forming apparatus is assumed to have a minimum size. A card-sized sheet (hereinafter, referred to as "card"), which has a size smaller than the minimum size, cannot be conveyed in the image forming apparatus. For that reason, in order to form an image on the card by the image forming apparatus, a user needs to attach the card onto a sheet having at least the minimum size capable of being conveyed in the image forming apparatus. After the sheet on which the card is attached is ejected from the image forming apparatus, the card needs to be manually separated by the user.

DETAILED DESCRIPTION

In general, according to one embodiment, a card separation apparatus includes a movable tray having a surface onto which a sheet is conveyed after a card has been separated from the sheet, and a card separation unit mounted on the surface for movement with the movable tray, the card separation unit having an opening through which the sheet is conveyed, and a controller configured to send an instruction to the movable tray to be moved at a predetermined timing after a leading edge of the sheet to which the card is attached enters the opening, so as to cause the sheet to be initially separated from the card.

In the following, an image forming system provided with an image forming apparatus and a sheet post-processing apparatus of the embodiments will be described with reference to the accompanying drawings.

Figure 1:
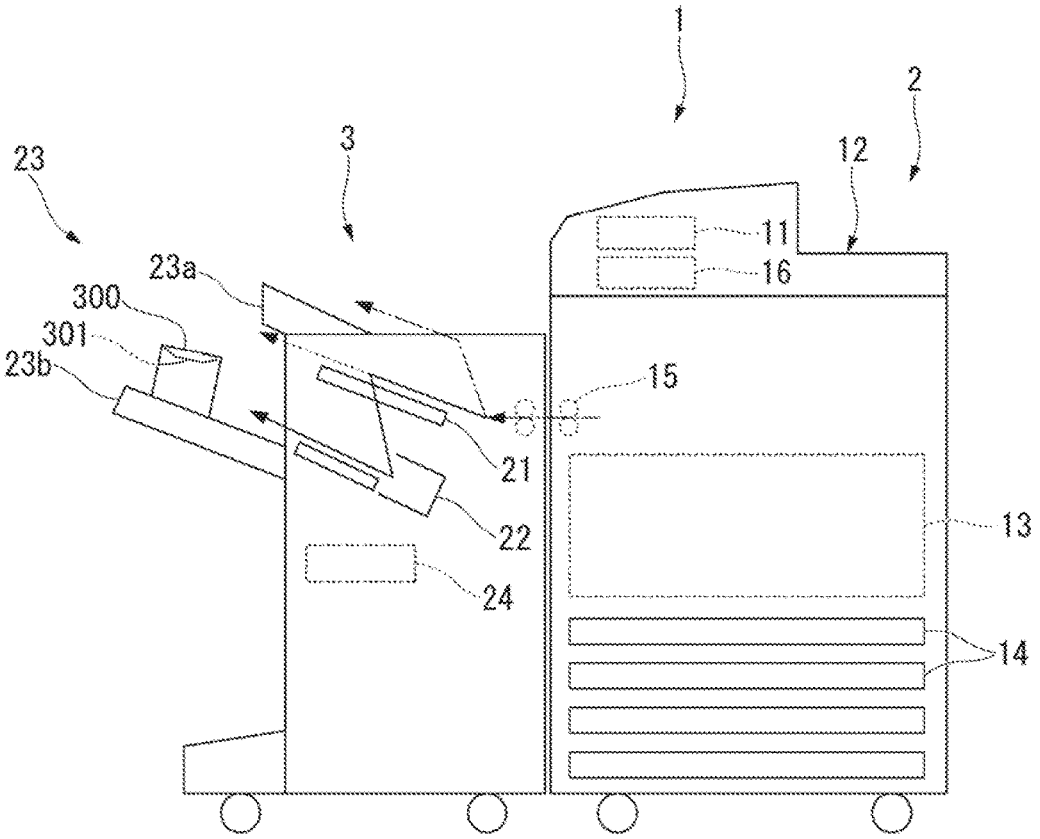
FIG. 1 illustrates a diagram of an image forming system according to an embodiment.
Figure 2:
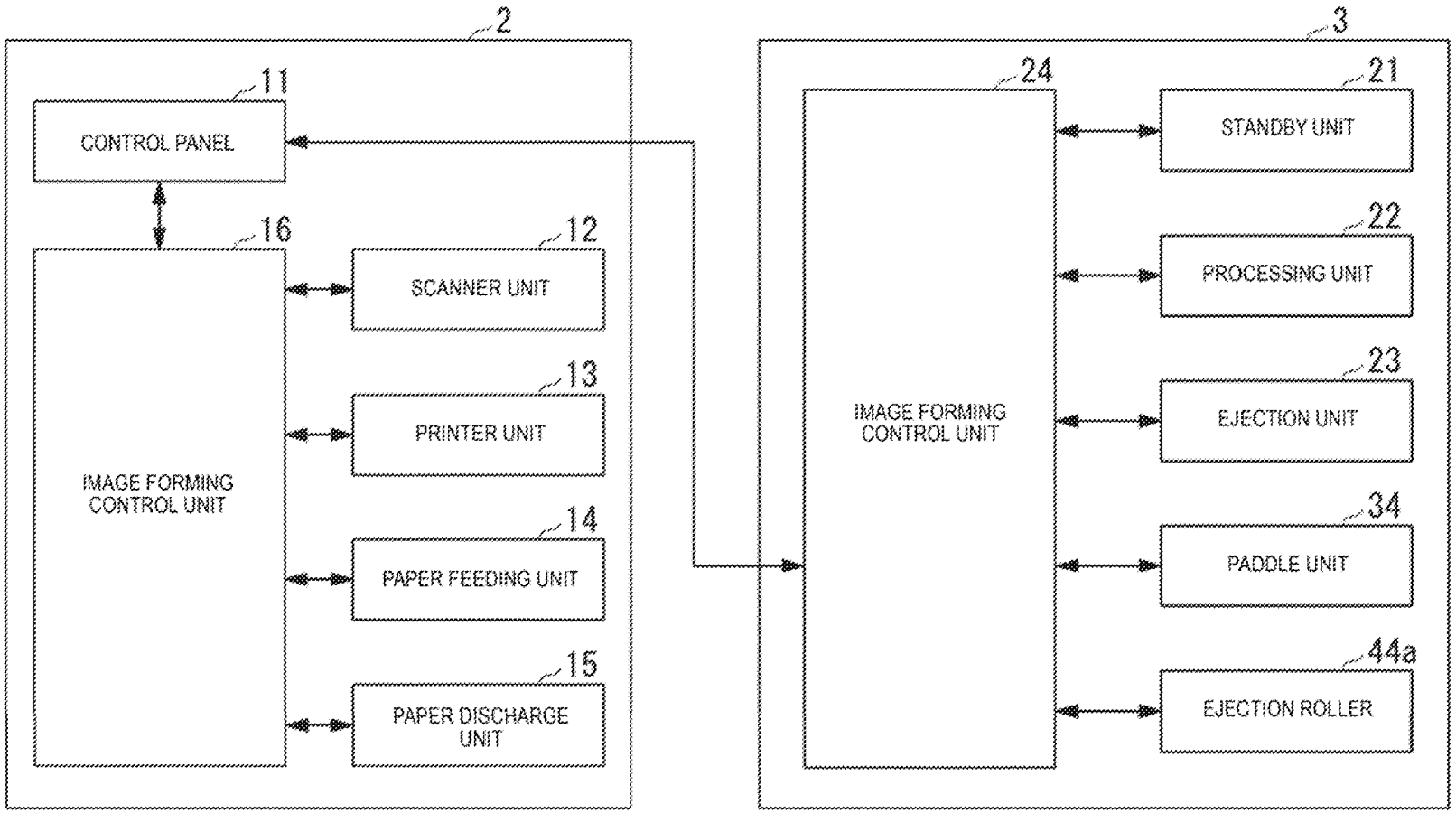
FIG. 2 illustrates a diagram of a functional configuration of the image forming system illustrated in FIG. 1.

FIG. 1 is a diagram illustrating an example of the entire configuration of an image forming system 1 according to an embodiment. FIG. 2 is a diagram illustrating an example of a functional configuration of the image forming system 1 illustrated in FIG. 1. The image forming system 1 includes an image forming apparatus 2 and a sheet post-processing apparatus 3. The image forming apparatus 2 forms an image on a medium (in the following, referred to as a "sheet") having a sheet shape such as paper. The sheet post-processing apparatus 3 performs post-processing on a sheet conveyed from the image forming apparatus 2.

The image forming apparatus 2 is provided with a control panel 11, a scanner unit 12, a printer unit 13, a paper feeding unit 14, a paper discharge unit 15, and an image forming control unit 16. The control panel 11 is provided with various keys receiving operations by a user. For example, the control panel 11 receives operation input by a user relating to a type of post-processing for a sheet. The control panel 11 sends information (including information about a type of a sheet) relating to the input type of post-processing to the sheet post-processing apparatus 3. A sheet is attached with a card. The card preserves its shape and returns to its original shape even when the card becomes bent. The sheet attached with the card is conveyed to the sheet post-processing apparatus 3 so that the surface of the sheet on which the card is attached faces upward. The card is separated by a card separation unit 300 provided in the sheet post-processing apparatus 3.

The scanner unit 12 is provided with a reading unit which reads image information of an object to be copied. The scanner unit 12 sends the read image information to the printer unit 13. The printer unit 13 forms an output image (in the following, referred to as a "toner image") by developer such as a toner, based on image information transmitted from the scanner unit 12 or external equipment. The printer unit 13 transfers a toner image onto a surface of the sheet. The printer unit 13 applies heat and pressure to the toner image transferred onto the sheet to fix the toner image onto the sheet. The paper feeding unit 14 supplies the sheet to the printer unit 13 one by one at the timing when the printer unit 13 forms the toner image. The paper discharge unit 15 discharges the sheet from the printer unit 13 to the sheet post-processing apparatus 3.

The image forming control unit 16 controls operations of the image forming apparatus 2 in its entirety. That is, the image forming control unit 16 controls the control panel 11, the scanner unit 12, the printer unit 13, the paper feeding unit 14, and the paper discharge unit 15. The image forming control unit 16 is formed with a control circuit including a central processing unit (CPU), a read only memory (ROM) and a random access memory (RAM).

Next, the sheet post-processing apparatus 3 will be described.

First, the entire configuration of the sheet post-processing apparatus 3 will be described. As illustrated in FIG. 1, the sheet post-processing apparatus 3 is disposed to be adjacent to the image forming apparatus 2. The sheet post-processing apparatus 3 performs post-processing designated through the control panel 11 on the sheet conveyed from the image forming apparatus 2. For example, post-processing is card separation processing, staple processing, or sort processing. The sheet post-processing apparatus 3 is provided with a standby unit 21, a processing unit 22, an ejection unit 23, a post-processing control unit 24, and the card separation unit 300. A finisher is an example of the sheet post-processing apparatus 3. The sheet post-processing apparatus 3 is one embodiment of the card separation apparatus.

The standby unit 21 receives the sheet S conveyed from the image forming apparatus 2 onto a standby tray 41 (explained later) and temporarily holds the sheet S (see FIG.

3). For example, the standby unit 21 makes a plurality of subsequent paper sheets S standby while post-processing for the preceding sheet S is performed by the processing unit 22. The standby unit 21 is provided above the processing unit 22. When the sheet, which is processed by the processing unit 22, is ejected from the ejection unit 23, the standby tray 41 of the standby unit 21 is retreated from, for example, above the processing unit 22 so as to drop the sheet S being held by the standby unit 21 toward the processing unit 22.

The processing unit 22 performs staple processing or sort processing on the sheet S. For example, the processing unit 22 aligns a plurality of sheets S. The processing unit 22 performs staple processing on the plurality of the aligned sheets S. With this, the plurality of the sheets S are bound. The processing unit 22 ejects the sheet S subjected to staple processing or sort processing to the ejection unit 23. The ejection unit 23 is provided with a fixed tray 23*a* and a movable tray 23*b*. The fixed tray 23*a* is provided at an upper portion of the sheet post-processing apparatus 3. The movable tray 23*b* is provided at a side portion of the sheet post-processing apparatus 3 such that the movable tray 23*b* can be movable in up and down direction. The sheet S subjected to staple processing or sort processing is ejected to the movable tray 23*b*.

The card separation unit 300 is provided at an upper portion of the movable tray 23*b*. The card separation unit 300 includes a card tray 301, a bridge member 302, and a pair of sidewalls 303. The side walls 303 are disposed upright on an upper surface of the movable tray 23*b*. Upper side ends of the side walls 303 support the ends of the bridge member 302. The card separation unit 300 has an internal space M through which the sheet S can pass, that is surrounded by a lower surface 302*b* of the bridge member 302, side surfaces of a pair of sidewalls 303, which face each other, and the upper surface of the movable tray 23*b*. The card tray 301 is formed in a center of the bridge member 302. The card tray 301 has a card receiving portion 301 which has a concave shape to receive a card.

The card separation unit 300 separates the card attached on the sheet S. Specifically, the sheet S is ejected so as to pass through the internal space M of the card separation unit 300. When a front end of the sheet enters the internal space M of the card separation unit 300, the movable tray 23*b* is moved downward. When the movable tray 23*b* moves downward, a height difference between upper surface 44*g* (FIG. 5) of an ejection port, at which the sheet is ejected from the sheet post-processing apparatus 3, and the internal space M of the card separation unit 300 is increased. By this movement, an upper surface of the front end portion of the sheet, which is not supported by the upper surface 44*g* of the ejection port, is pushed down and deformed by the lower surface 302*b* of the bridge member 302 which moves downward according to an increase in the height difference. As a result, a portion of the card becomes separated from the sheet as the sheet S is conveyed. The sheet is further conveyed while a portion of the card is being separated such that the card is entirely separated from the sheet. The separated card is received on the card receiving portion 301 of the card tray 301 included in the card separation unit 300.

The post-processing control unit 24 controls operations of the sheet post-processing apparatus 3 in its entirety. That is, the post-processing control unit 24 controls the standby unit 21, the processing unit 22, and the ejection unit 23. As illustrated in FIG. 2, the post-processing control unit 24 controls a paddle unit 34 and the ejection roller 44*a* which will be described later. The post-processing control unit 24 is formed with a control circuit including the CPU, the ROM, and the RAM.

Figure 3:
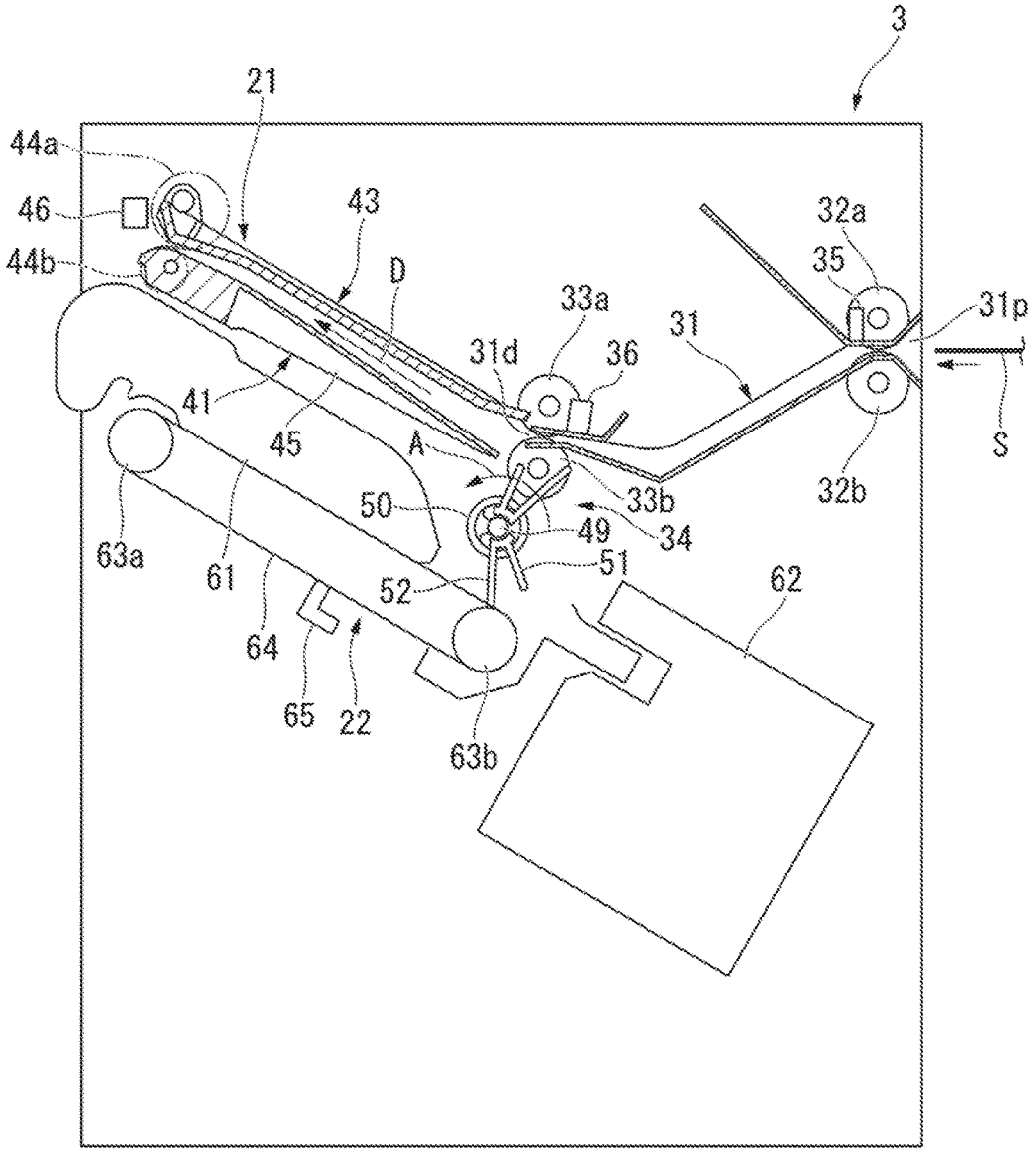
FIG. 3 illustrates a schematic diagram of a configuration of a sheet post-processing apparatus of the embodiment.

Next, configurations of respective components of the sheet post-processing apparatus 3 of embodiment will be described in detail. FIG. 3 is a diagram schematically illustrating a configuration of the sheet post-processing apparatus 3 of the embodiment. As illustrated in FIG. 3, the sheet post-processing apparatus 3 includes a conveying path 31 of the sheet S, a pair of inlet rollers 32*a* and 32*b*, a pair of outlet rollers 33*a* and 33*b*, the pair of ejection rollers 44*a* and 44*b*, the standby unit 21, the paddle unit 34, and the processing unit 22.

A "sheet conveying direction" in the present specification means a conveying direction D (an entering direction of the sheet S into the standby tray 41) of the sheet S with respect to the standby tray 41 of the standby unit 21. In the present specification, an "upstream side" and a "downstream side" mean an upstream side and a downstream side in the sheet conveying direction D, respectively. In the present specification, a "front end portion" and a "rear end portion" mean an "end portion of the downstream side" and an "end portion of the upstream side" in the sheet conveying direction D, respectively. Also, in the present specification, a direction which is substantially parallel to an upper surface of the standby tray 41 and substantially orthogonal to the sheet conveying direction D is referred to as a sheet width direction W.

The conveying path 31 is provided inside the sheet post-processing apparatus 3. The conveying path 31 includes a sheet supply port 31*p* and a sheet ejection port 31*d*. The sheet supply port 31*p* faces the image forming apparatus 2. The sheet S is supplied to the sheet supply port 31*p* from the image forming apparatus 2. On the other hand, the sheet ejection port 31*d* is positioned in the vicinity of the standby unit 21. The sheet S passing through the conveying path 31 is ejected onto the standby tray 41 of the standby unit 21 from the sheet ejection port 31*d*.

The inlet rollers 32*a* and 32*b* are provided in the vicinity of the sheet supply port 31*p*. The inlet rollers 32*a* and 32*b* convey the sheet S supplied to the sheet supply port 31*p* toward the downstream side of the conveying path 31. For example, the inlet rollers 32*a* and 32*b* convey the sheet S supplied to the sheet supply port 31*p* to the outlet rollers 33*a* and 33*b*. An inlet sensor 35 is provided in the vicinity of the inlet roller 32*a* and detects the sheet S passing through the sheet supply port 31*p*. For example, the inlet sensor 35 outputs a detection signal of a high level while detecting of the sheet S is performed whereas outputs a detection signal of a low level while detecting of the sheet S is not performed.

The outlet rollers 33*a* and 33*b* are provided in the vicinity of the sheet ejection port 31*d*. The outlet rollers 33*a* and 33*b* receive the sheet S conveyed by the inlet rollers 32*a* and 32*b*. The outlet rollers 33*a* and 33*b* convey the sheet S from the sheet ejection port 31*d* to the standby unit 21. An outlet sensor 36 is provided in the vicinity of the outlet roller 33*a* and detects the sheet S passing through the sheet ejection port 31*d*. For example, the outlet sensor 36 outputs a detection signal of a high level while detecting of the sheet S is performed whereas outputs a detection signal of a low level while detecting of the sheet S is not performed.

Next, the standby unit 21 will be described. The standby unit 21 includes a standby tray (buffer tray) 41, a conveying guide 43, ejection rollers 44*a* and 44*b*, and an ejection sensor 46. The standby tray 41 is an example of a "second tray". The rear end portion of the standby tray 41 is positioned in the vicinity of the outlet rollers 33*a* and 33*b* to receive the sheet from the outlet rollers 33*a* and 33*b*. The standby tray 41 makes a plurality of sheets S standby to be stacked while post-processing is performed by the processing unit 22. The standby tray 41 includes a bottom wall 45 which supports the sheet S from below. The bottom wall 45 is configured with, for example, two plate-like members arranged in parallel to the sheet conveying direction. The two plate-like members receive the sheet S on the surface thereof. The two plate-like members are retreated so as to be separated by being divided into the right-and-left direction, which is perpendicular to the sheet conveying direction D, to drop the held sheet S onto the processing tray 61.

The ejection rollers 44*a* and 44*b* are provided in the vicinity of the ejection unit 23. The ejection rollers 44*a* and 44*b* receive the sheet S conveyed along the conveying guide 43. The ejection rollers 44*a* and 44*b* apply a conveying force to the sheet S to be conveyed to the ejection unit 23. The ejection roller 44*a* is a driving roller. On the other hand, the ejection roller 44*b* is a driven roller. In a case of a sheet attached with a card, the sheet is conveyed to the movable tray 23*b*. The ejection sensor 46 is provided in the vicinity of the ejection roller 44*a* and detects the front end of the sheet S passing through the ejection unit 23. For example, the ejection sensor 46 outputs a detection signal of a high level while the sheet S is detected, and outputs a detection signal of a low level while the sheet S is not detected.

The paddle unit 34 is provided between the standby tray 41 and the processing tray 61. When the sheet S is conveyed from the standby tray 41 toward the processing tray 61, the paddle unit 34 rotates so as to push the sheet S toward the processing tray 61. Furthermore, the paddle unit 34 conveys the sheet S dropped onto the processing tray 61 toward a stapler 62 which will be described later. The paddle unit 34 includes a rotation shaft 49, a rotation body 50, a plurality of first paddles 51 and a plurality of second paddles 52.

Next, the processing unit 22 will be described. The processing unit 22 includes the processing tray 61, the stapler 62, conveying rollers 63*a* and 63*b*, a conveying belt 64, and a restraining pawl 65. The processing tray 61 is an example of a "first tray". The processing tray 61 is provided below the standby tray 41. A plurality of sheets S conveyed to the processing tray 61 are aligned by an alignment plate or the like in the sheet width direction W and the sheet conveying direction D. The stapler 62 is provided at an end portion of the processing tray 61. The stapler 62 performs staple processing (binding) on a bundle of a predetermined number of sheets S positioned on the processing tray 61.

The conveying rollers 63*a* and 63*b* are disposed at predetermined intervals in the sheet conveying direction D. The conveying belt 64 is stretched between the conveying rollers 63*a* and 63*b*. The conveying belt 64 is rotated by being synchronized with the conveying rollers 63*a* and 63*b*. The conveying belt 64 conveys the sheet S between the stapler 62 and the ejection unit 23.

The post-processing control unit 24 of the sheet post-processing apparatus 3 controls the conveying speed of the sheet S by controlling the number of rotations of the outlet rollers 33*a* and 33*b* when ejecting the sheet S to the processing tray 61. In the following, description will be made on conveying speed control of the sheet S in the post-processing control unit 24 in a first exemplary embodiment. The sheet S is assumed to be in a state of being ejected directly onto the processing tray 61 without passing through the standby tray 41, on the premise that the conveying speed control of the sheet S is performed in first exemplary embodiment.

A restraining hook 65 is a pushing-out member which is provided on the conveying belt 64 and driven integrally with the conveying belt 64. The restraining hook 65 is driven together with the conveying belt 64 to move the sheet S on the processing tray 61 to the downstream side in the conveying direction. When the sheet S is conveyed to the processing tray 61, the restraining hook 65 is retreated from a sheet placement surface of the processing tray 61.

Figure 4:
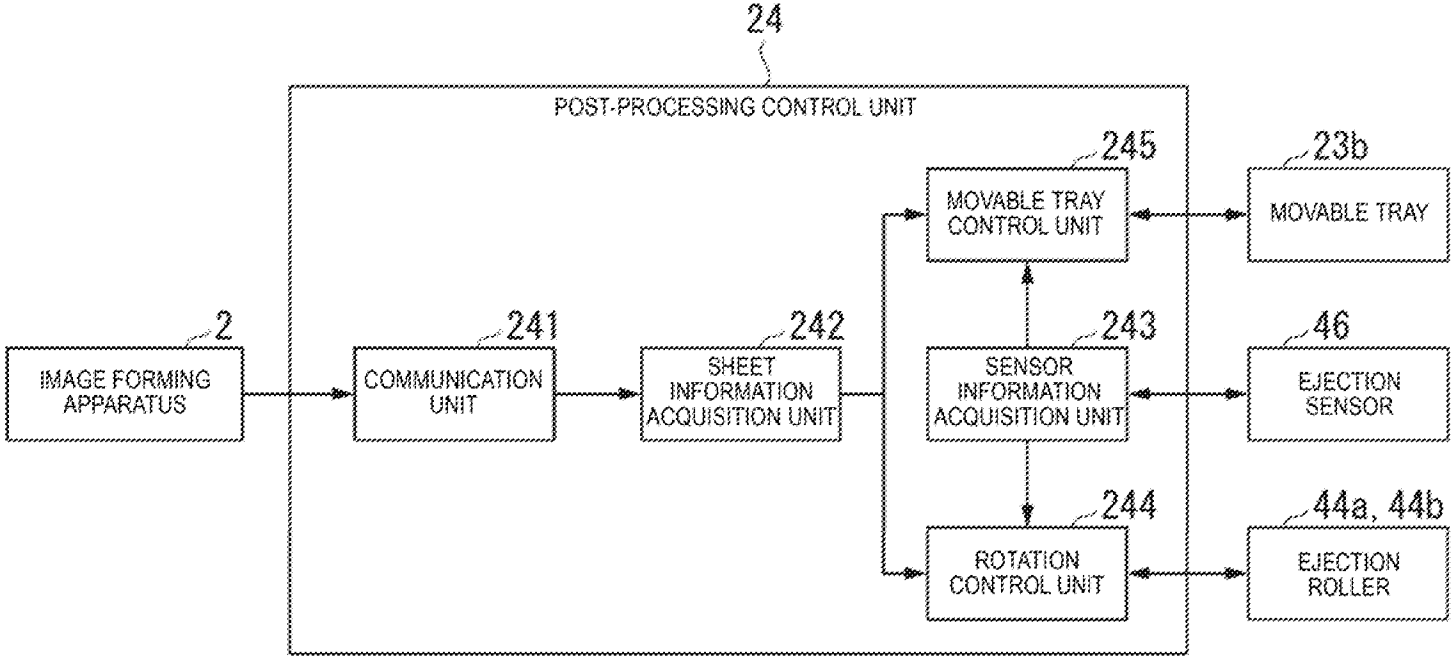
FIG. 4 illustrates a functional block diagram relating to control of sheet separation processing in a post-processing control unit of the embodiment.

FIG. 4 is diagram illustrating functional blocks relating to control of sheet separation processing in the post-processing control unit 24 of the exemplary embodiment. As illustrated in FIG. 4, the post-processing control unit 24 is provided with a communication unit 241, a sheet information acquisition unit 242, a sensor information acquisition unit 243, a rotation control unit 244, and a movable tray control unit 245.

The communication unit 241 performs communication with the control panel 11 of the image forming apparatus 2. The sheet information acquisition unit 242 acquires information of an operation input indicating a type of post-processing selected by a user from the control panel 11 through the communication unit 241 and information about a type of the sheet S to be subjected to post-processing. The information about the type of the sheet S includes information relating to a size of the sheet S (information such as A4 or A3), information about basis weight of the sheet S, information about a material of the sheet S, information of whether a card is attached onto a sheet or not, and the like. Basis weight of the sheet S is weight of the sheet S $g/m^2$ per square meter. When the card is attached to the sheet, information about a position on the sheet where the card is attached and the number of cards may be included.

The sensor information acquisition unit 243 acquires a detection signal according to detection of the sheet S, which passes through the ejection unit 23, from the ejection sensor 46. In the following description, a detection signal of a high level indicating that the sheet S is detected is referred to as an ON signal and a detection signal of a low level indicating that the sheet S is not detected is referred to as an OFF signal.

The rotation control unit 244 controls rotation of the ejection rollers 44*a* and 44*b* conveying the sheet S based on information about the sheet S acquired by the sheet information acquisition unit 242 and the detection signal acquired by the sensor information acquisition unit 243.

The rotation control unit 244 controls the number of rotations of a driving motor which rotates the ejection rollers 44*a* and 44*b* by a pulse rate (pps: pulses per second). That is, the rotation control unit 244 controls the rotational speed of the ejection rollers 44*a* and 44*b* so as to control the conveying speed of the sheet S. The rotation control unit 244 sets a first speed of the sheet S as v1 (*pps*) and sets a second speed as v2 (pps) based on, for example, information about the sheet S. The first speed v1 (*pps*) and the second speed v2 (*pps*) of the sheet S are just examples and the rotation control unit 244 may set an arbitrary value according to the size and basis weight of the sheet S, as the conveying speed.

As the conveying speed of the sheet S, there are a first speed at which the sheet S is conveyed in the conveying path 31 and a second speed which is suitable for ejecting the sheet S to the processing tray 61 (where first speed > second speed). The speed suitable for ejecting the sheet S to the processing tray 61 is a speed at which the ejected sheet S lands on a predetermined position of the processing tray 61. That is, the post-processing control unit 24 controls such that the sheet S is conveyed in the conveying path at the first speed or the second speed. The rotation control unit 244 reduces the conveying speed before the front end portion of the sheet S collides with the processing tray 61 based on the timing at which the detection signal becomes the ON signal and the size of the sheet S. The timing at which the detection becomes the ON signal is the timing at which the front end portion of the sheet S passing through the sheet ejection port 31*d*. The expression of "before the front end portion of the sheet S collides to the processing tray 61" means a period of time which is before the front end portion of the sheet S comes in contact with the processing tray 61 and after the front end portion of the sheet S passed through the sheet ejection port 31*d*.

It is possible to predict how far the front end portion of the sheet S is conveyed from the sheet ejection port 31*d* and when the front end portion of the sheet S collides to the processing tray 61, based on the size and basis weight of the sheet S and a distance from the sheet ejection port 31*d* to the processing tray 61. Here, a conveying amount extending from the sheet ejection port 31*d* to a position until right before the front end portion of the sheet S collides to the processing tray 61 is set as a first conveying amount. The rotation control unit 244 monitors the conveying amount of the sheet S from a time point at which the front end portion of the sheet S passes through the sheet ejection port 31*d* and decelerates at a time point at which the sheet S is conveyed by the first conveying amount. The rotation control unit 244 also sets the first conveying amount when setting the first speed and the second speed based on information about the sheet S.

The movable tray control unit 245 controls a vertical movement of the movable tray 23*b* based on information about the sheet S acquired by the sheet information acquisition unit 242 and the detection signal acquired by the sensor information acquisition unit 243.

When the ON signal generated by the ejection sensor 46 is received from the sensor information acquisition unit 243, the movable tray control unit 245 controls the movable tray 23*b* to be moved down to a lower portion of the sheet post-processing apparatus 3. The movable tray control unit 245 determines the timing at which the movable tray 23*b* is to be moved down to the lower portion of the sheet post-processing apparatus 3 based on information about the sheet S.

Figure 5:
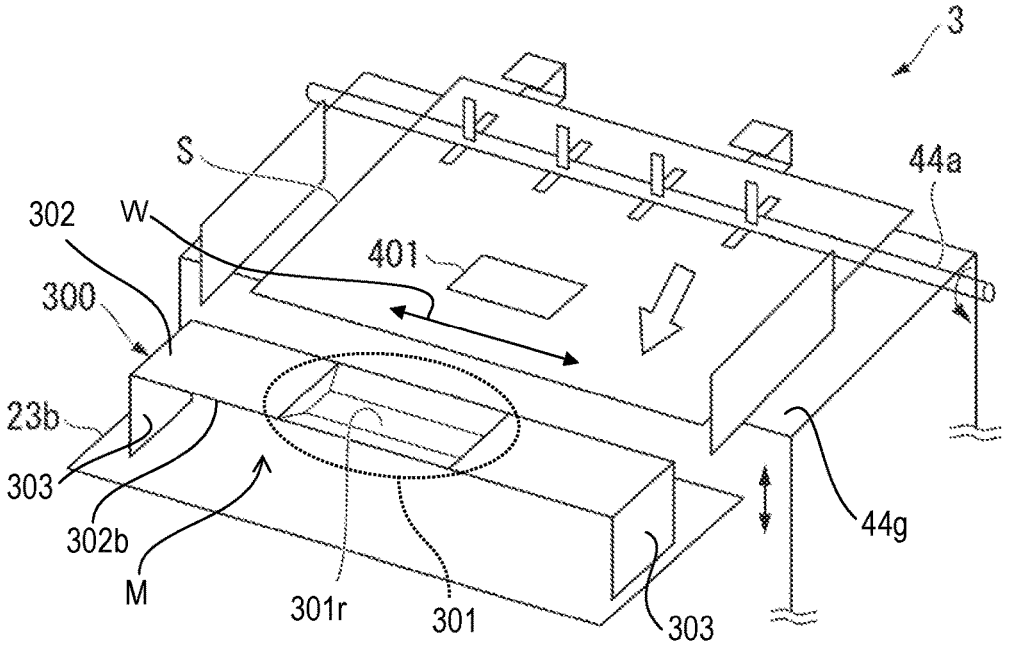
FIG. 5 illustrates a schematic diagram of a configuration of a card separation unit of the embodiment.

FIG. 5 is a diagram schematically illustrating a configuration of the card separation unit 300 of the embodiment. As illustrated in FIG. 5, the card separation unit 300 includes the card tray 301. The card separation unit 300 is provided on the movable tray 23*b*. The sheet S is ejected from the sheet post-processing apparatus 3 so that the surface of the sheet on which the card is attached faces upward (face up manner) due to the rotation of the ejection rollers 44*a* and 44*b* (see FIG. 3). The movable tray 23*b* is moved down to the lower portion at a predetermined timing such that a card 401 separated from the sheet is accumulated in the card tray 301. A plurality of the card trays 301 may be provided.

Figure 6:
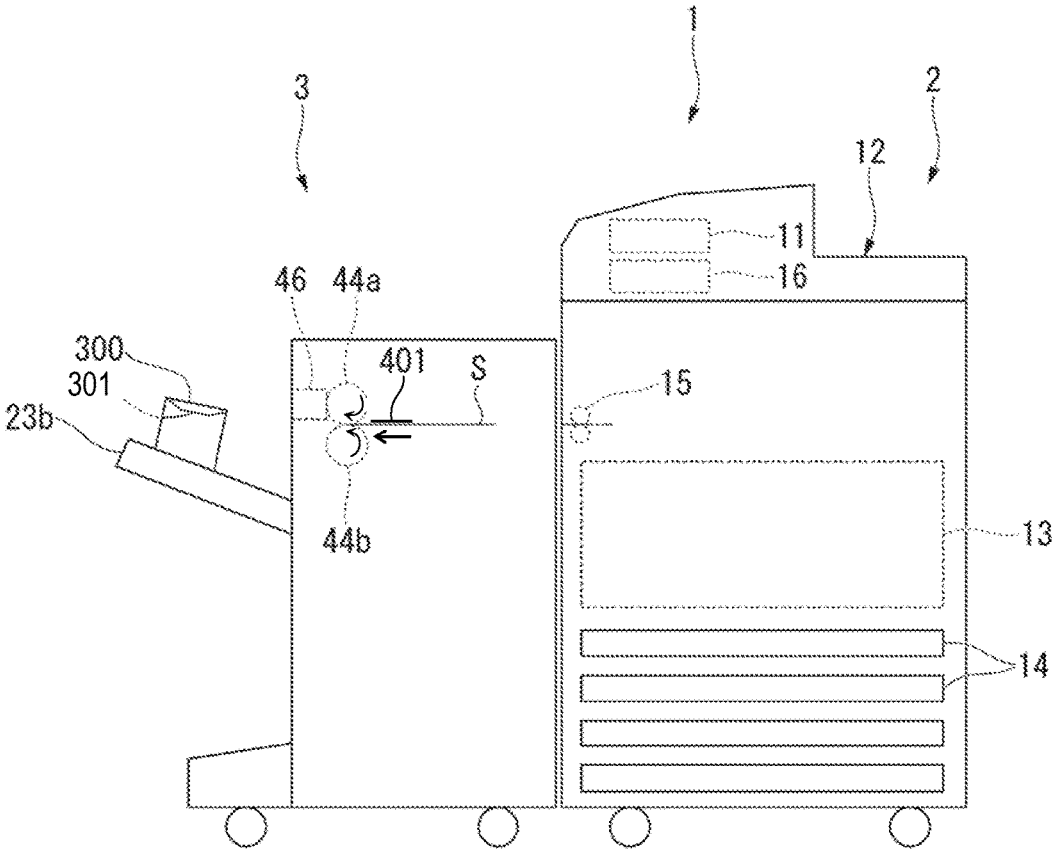
FIG. 6 illustrates a diagram of a state in which a sheet is present in a processing tray.

FIG. 6 to FIG. 9 are diagrams schematically illustrating a flow of card separation processing according to the embodiment. FIG. 6 is a diagram illustrating a state in which a sheet S is present in the processing tray 61 of the embodiment. The sheet S disposed in the processing tray 61 is conveyed to the ejection unit 23 by a conveying force applied from the ejection rollers 44*a* and 44*b*. The ejection sensor 46 detects the front end portion of the sheet S passing through the ejection unit 23. The ejection sensor 46 outputs the detection signal of the high level while the sheet S is detected.

Figure 7:
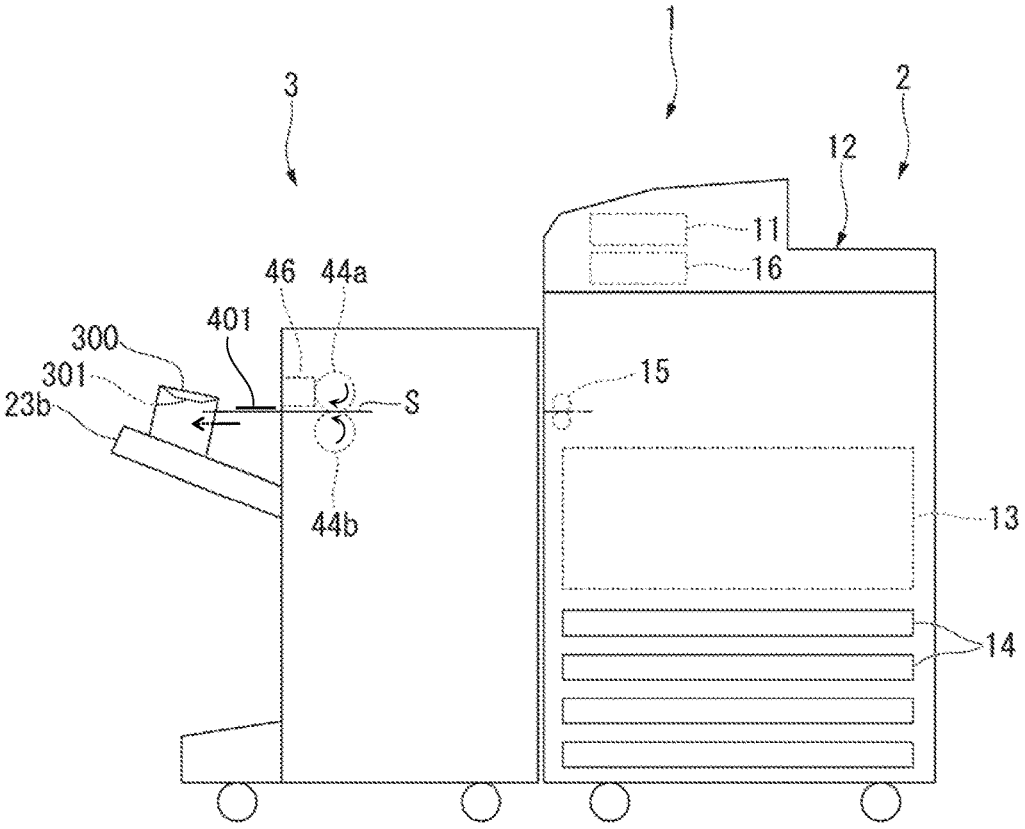
FIG. 7 illustrates a diagram of a state in which ejection from the processing tray to a movable tray is started.

FIG. 7 is a diagram illustrating a state in which ejection from the processing tray 61 to the movable tray 23*b* of the embodiment is started. The front end portion of the sheet S ejected onto the movable tray 23*b* is conveyed into the lower portion of the card separation unit 300.

Figure 8:
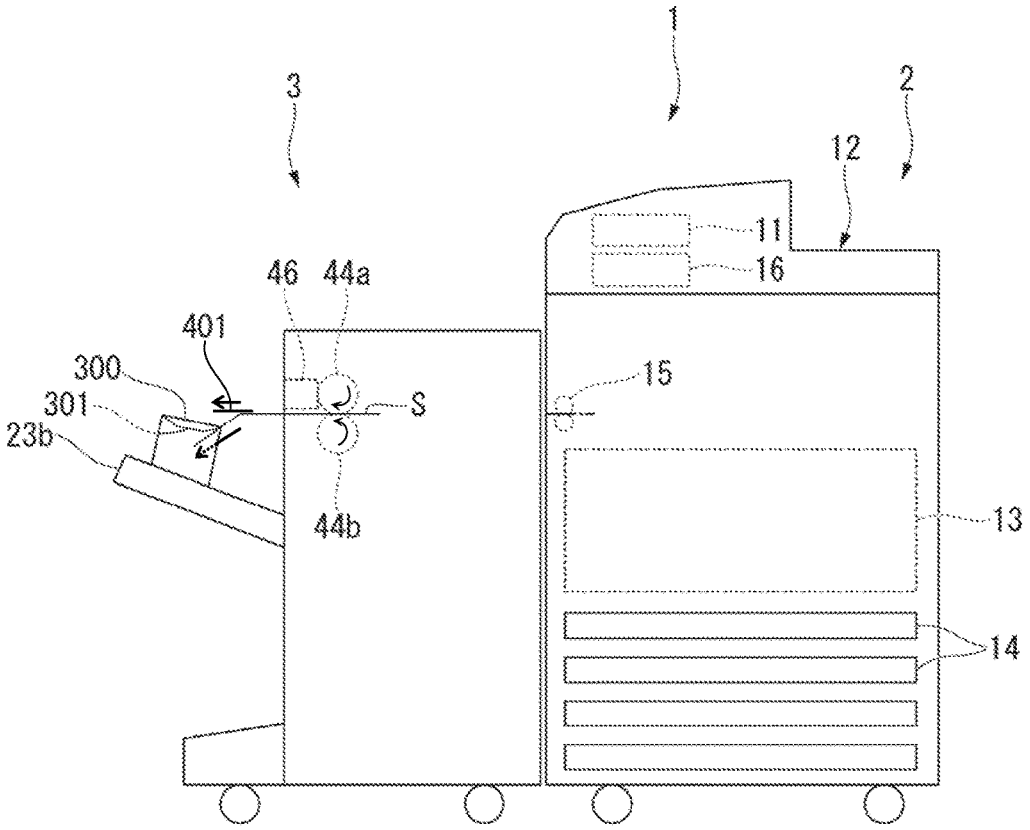
FIG. 8 illustrates a diagram of a state in which the movable tray is made to descend such that the sheet is deformed.

FIG. 8 is a diagram illustrating a state in which the movable tray 23*b* of the embodiment is made to descend such that the sheet S is deformed. When the sheet S is conveyed into the lower portion of the card separation unit 300 from the front end portion of the sheet S by a predetermined length, the movable tray 23*b* descends based on the instruction of the movable tray control unit 245. When the movable tray 23*b* descends, the front end of the sheet S is pushed downward by the card separation unit 300 and is bent. When the sheet is bent, the card 401 is separated from the bent sheet. The predetermined length is a length corresponding to a downward-push degree of the sheet S when the movable tray 23*b* descends. The predetermined length may differ according to the type of the sheet.

Figure 9:
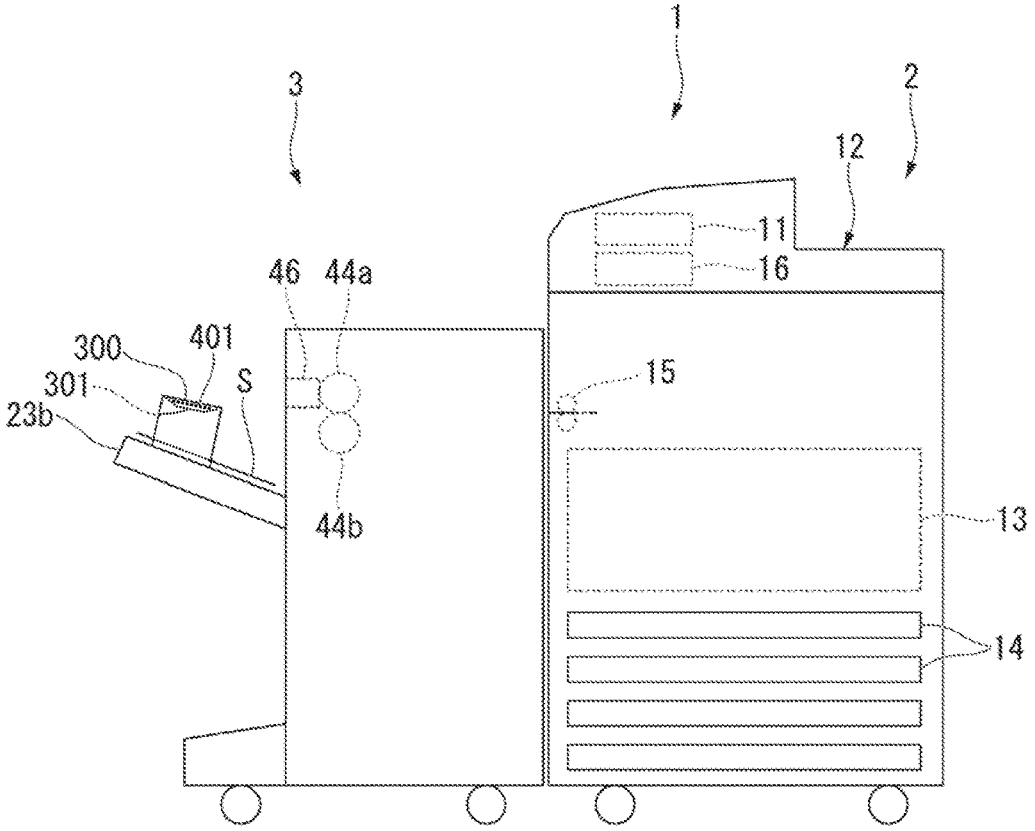
FIG. 9 illustrates a diagram of a state in which ejection of the sheet is completed.

FIG. 9 is a diagram illustrating a state in which ejection of the sheet S is completed. The ejection rollers 44*a* and 44*b* further convey the sheet S in a state where the movable tray 23*b* is moved down to the lower portion and the sheet S is downwardly bent. When the sheet S is entirely conveyed to the ejection rollers 44*a* and 44*b*, the sheet S is dropped onto the upper portion of the movable tray 23*b*. When the sheet S is entirely conveyed to the ejection rollers 44*a* and 44*b*, the card 401 is completely separated from the sheet S. The card 401 separated from the sheet S drops onto the card tray 301 included in the card separation unit 300 and card separation processing is ended.

Figure 10:
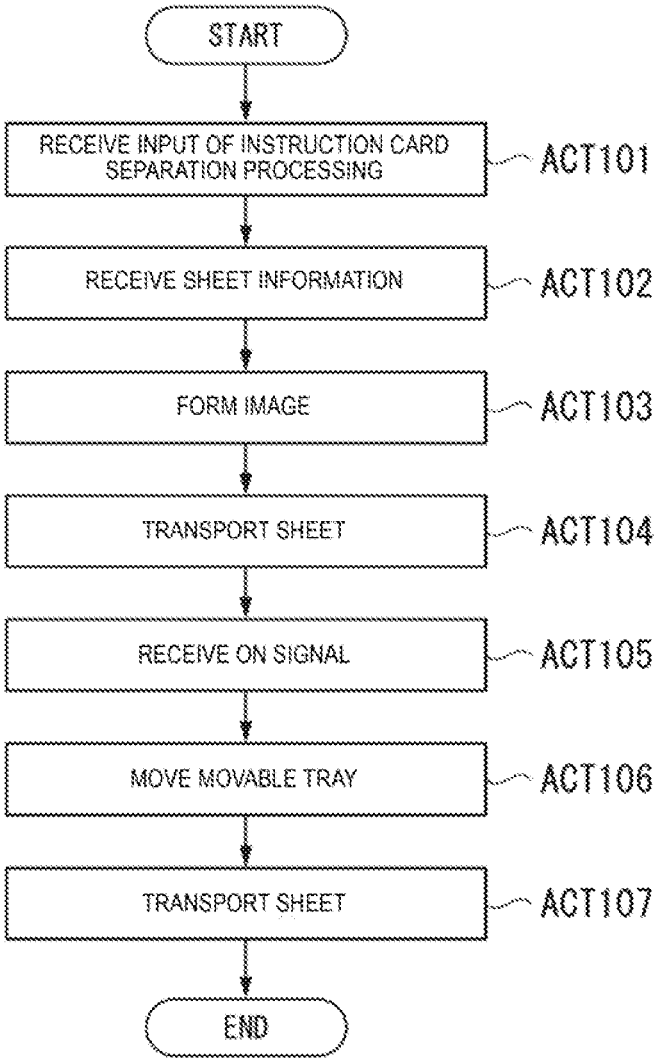
FIG. 10 is a flowchart depicting a flow of card separation processing according to an embodiment.

FIG. 10 is a flowchart depicting a flow of card separation processing according to an embodiment. The control panel 11 of the image forming apparatus 2 receives input of instruction card separation processing from a user (ACT 101). The control panel 11 receives information about the sheet from the user (ACT 102). The printer unit 13 of the image forming apparatus 2 forms an image on the card attached to the sheet (ACT 103). The sheet on which an image is formed is supplied to the sheet post-processing apparatus 3 and is conveyed in the conveying path 31 (ACT 104). When the conveyed sheet comes close to the ejection sensor 46, the sensor information acquisition unit 243 of the sheet post-processing apparatus 3 receives the ON signal from the ejection sensor 46 (ACT 105). The movable tray control unit 245 moves down the movable tray 23*b* to the lower portion at a predetermined timing based on information about the sheet received from the control panel 11 and the ON signal received from the sensor information acquisition unit 243 (ACT 106). The ejection rollers 44*a* and 44*b* rotate until the sheet is entirely conveyed (ACT 107). When the sheet is ejected from the sheet post-processing apparatus 3, the processing is ended.

By adopting the configuration described above, the movable tray 23*b* descends at a predetermined timing so as to make it possible for the card separation unit 300 to separate the card attached to the sheet. The sheet is further conveyed in a state of being separated such that the card is completely separated from the sheet. Accordingly, the user may acquire the card from the sheet more efficiently.

In the embodiment described above, processing for separating the card from the sheet by allowing the ejection rollers 44*a* and 44*b* to convey the sheet was described in detail. However, a mechanism used for conveying the sheet in order to separate the card is not limited to the ejection rollers 44*a* and 44*b*. For example, a mechanism which applies a force pushing out the sheet from the rear may be included, instead of the ejection rollers 44*a* and 44*b*. For example, the processing unit 22 may drive the conveying belt 64 in a state where the sheet is pushed by the paddle unit 34 so as to cause the restraining hook 65 to move the sheet. The conveying belt 64 is driven so as to cause the restraining hook 65 to abut on the edge of the sheet on the upstream side in the conveying direction. The restraining hook 65 pushes out the edge of the sheet on the upstream side in the conveying direction toward the downstream side in conveying direction. The restraining hook 65 pushes out the sheet so as to be conveyed to the movable tray 23*b* such that the sheet is moved down to the lower portion of the card separation unit 300.

In the embodiment described above, control that causes the ejection sensor 46 to detect the conveyed sheet so as to move the movable tray 23*b* to the lower portion was described in detail. However, control that causes the movable tray 23*b* to be moved down to lower portion in order to separate the card is not limited to the configuration in which the sheet is detected by the ejection sensor 46. For example, control that causes the movable tray 23*b* to be moved down to the lower portion may be performed, after a predetermined time elapses from image formation on the sheet. The predetermined time is, for example, the time required for allowing the conveyed sheet to be entered into the lower portion of the card separation unit 300 by a predetermined length. The predetermined time is determined based on information about the sheet received from the control panel 11 and the conveying speed of the sheet. By adopting the configuration described above, sheet separation processing becomes possible without providing the ejection sensor 46 in the vicinity of the ejection rollers 44*a* and 44*b*.

In the embodiment described above, a case where the card separation unit 300 includes a single card tray 301 was described in detail. The card separation unit 300 may include a plurality of card trays 301. By adopting the configuration described above, even when a plurality of cards are attached to the sheet, the card may be efficiently separated.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A card separation apparatus comprising:

a movable tray having a surface onto which a sheet is conveyed after a card has been separated from the sheet, and a card separation unit mounted on the surface for movement with the movable tray, the card separation unit having an opening through which the sheet is conveyed; and a controller configured to send an instruction to the movable tray to be moved at a predetermined timing after a leading edge of the sheet to which the card is attached enters the opening, so as to cause the sheet to be initially separated from the card.

2. The apparatus according to claim 1, wherein the movable tray is movable up and down, and the controller controls the movable tray to move down at the predetermined timing.

3. The apparatus according to claim 2, wherein the controller controls the movable tray to move down at the predetermined timing and stay down until the card has separated completely from the sheet and the sheet is conveyed onto the surface of the movable tray.

4. The apparatus according to claim 3, wherein the card separation unit includes a card tray at an upper surface of the card separation unit, the card tray being positioned to receive the card that is separated from the sheet by the card separation unit and shaped to hold the separated card.

5. The apparatus according to claim 4, wherein the card tray has a concave portion and the separated card is received into the concave portion.

6. The apparatus according to claim 1, further comprising a conveying roller configured to convey the sheet to the movable tray and through the opening of the card separation unit.

7. The apparatus according to claim 6, further comprising:

an ejection sensor configured to detect a sheet conveyed by the conveying roller, wherein the controller determines the predetermined timing based on detection signals from the ejection sensor.

8. The apparatus according to claim 1, further comprising a restraining pawl configured to discharge the sheet through the opening of the card separation unit.

9. The apparatus according to claim 1, wherein the controller is configured to determine the predetermined timing based on information about the sheet and a conveying speed of the sheet.

10. The apparatus according to claim 9, further comprising a communication unit configured to receive the information about the sheet from outside of the card separation apparatus.

11. The apparatus according to claim 9, wherein the information about the sheet includes size information of the sheet.

12. A card separation method comprising:

conveying a sheet having a card attached thereto towards a movable tray having a surface onto which the sheet is to be conveyed after the card is separated from the sheet and a card separation unit mounted on the surface for movement with the movable tray, the card separation unit having an opening through which the sheet is to be conveyed; and at a predetermined timing after a leading edge of the sheet enters the opening, lowering the movable tray and causing the sheet to be initially separated from the card.

13. The method according to claim 12, further comprising:

maintaining the movable tray at the lowered position until the card has separated completely from the sheet and the sheet is conveyed onto the surface of the movable tray.

14. The method according to claim 13, wherein the card separation unit includes a card tray at an upper surface of the card separation unit, the card tray being positioned to receive the card that is separated from the sheet by the card separation unit and shaped to hold the separated card.

15. The method according to claim 14, wherein the card tray has a concave portion and the separated card is received into the concave portion.

16. The method according to claim 12, further comprising:

detecting a sheet conveyed by the conveying roller using a sensor that is placed at an upstream side of the card separation unit, wherein the predetermined timing is determined based on detection signals from the sensor.

17. The method according to claim 12, further comprising:

discharging the sheet through the opening of the card separation unit using a restraining pawl.

18. The method according to claim 12, further comprising:

determining the predetermined timing based on information about the sheet and a conveying speed of the sheet.

19. The method according to claim 18, wherein the information about the sheet includes size information of the sheet.

20. The method according to claim 19, wherein the information about the sheet further includes a position of the card on the sheet.

* * * * *